United States Patent [19]

Lucas

[11] Patent Number: 4,886,250

[45] Date of Patent: Dec. 12, 1989

[54] SPRING STRUCTURE FOR CUSHION SEATING

[75] Inventor: Thomas H. Lucas, Cambridge, Wis.

[73] Assignee: Schweiger Industries, Inc., Jefferson, Wis.

[21] Appl. No.: 83,665

[22] Filed: Aug. 7, 1987

[51] Int. Cl.[4] ..... F16F 3/02; A47C 23/053; A47C 23/28

[52] U.S. Cl. ..... 267/95; 267/87; 267/89; 267/91; 267/100; 267/103; 5/248; 5/264 R

[58] Field of Search ..... 5/238, 248, 263, 264, 5/256; 267/86, 87, 89, 90, 91, 100, 101, 104, 103, 93, 94, 95, 131, 133, 259, 177, 142, 144, 143

[56] References Cited

U.S. PATENT DOCUMENTS

| | | | |
|---|---|---|---|
| 256,666 | 4/1882 | Ford | 5/238 X |
| 316,444 | 4/1885 | Burr | 267/89 |
| 2,234,253 | 3/1941 | Hopkes | 267/87 |
| 2,280,912 | 4/1942 | Hopkes . | |
| 2,305,530 | 12/1942 | Hopkes | 267/87 |
| 2,685,328 | 8/1954 | Hopkes, Jr. . | |
| 2,985,895 | 5/1961 | Bloom | 5/248 |
| 3,059,249 | 10/1962 | Kamp . | |
| 3,624,846 | 12/1971 | Rub . | |
| 4,597,566 | 7/1986 | Scrivner . | |

FOREIGN PATENT DOCUMENTS

| | | | |
|---|---|---|---|
| 887863 | 8/1953 | Fed. Rep. of Germany | 267/89 |
| 920440 | 10/1954 | Fed. Rep. of Germany | 267/95 |
| 538983 | 6/1922 | France | 5/238 |
| 328244 | 4/1930 | United Kingdom | 5/264 |

OTHER PUBLICATIONS

Advertisement appearing in Apr. 1987, *Upholstery Manufacturing Management*, vol. 7, No. 4, p. 9.

*Primary Examiner*—Andres Kashnikow
*Assistant Examiner*—Richard Potosnak
*Attorney, Agent, or Firm*—Michael, Best & Friedrich

[57] ABSTRACT

An adjustable coil seat is provided which utilizes the combination of a plurality of parallel rows of sinuous springs which are connected at opposite ends of the frame, at least one row of tapered conical coil springs in transverse relation to the sinuous springs and positioned in supporting relationship under the sinuous springs at a location between the ends of the sinuous springs, and a rigid cross-support beam structure which supports the bottom end of the tapered coiled springs. The cross support structure may be of adjustable height to vary pretension of the spring mechanism.

18 Claims, 6 Drawing Sheets

SPRING STRUCTURE FOR CUSHION SEATING

BACKGROUND OF THE INVENTION

1. Field of the Invention

The present invention is generally directed to a spring structure for upholstered cushion seating, and is specifically directed to spring structure including a sinuous spring and a coil spring which is placed between a rigid support frame and the upholstery padding material in a sofa, chair or the like.

2. Description of Prior Art

Perhaps the most significant breakthrough in the development of modern seat cushions was the adaptation of a spring structure for upholstered cushion seating. Prior to the use of springs, cushions were simply stuffed with matting, fill or other soft fibers. After a period of use, the cushion stuffing would settle, often resulting in a hard, lumpy, uncomfortable cushion.

The advent of the coil spring solved many of the prior problems. The early coil springs were placed in a frame under the seat cushion padding in a sufficient number of rows to provide proper seating support. The coil springs advantageously provided a consistent spring resilience throughout the seating area. However, this manner of providing cushion seating was expensive due to the large number of coil springs needed to support a cushion in a consistent manner.

The development of the sinuous spring caused many manufacturers to adopt this spring as an economical substitute for the prohibitively priced coil spring structure. The sinuous springs have a zig-zag pattern and are disposed in an upwardly bending arc between two parallel sides of a frame. Rows of sinuous wire springs are generally attached in a parallel alignment between the front and rear walls of cushion seating frames, offering both comfort and resilience. While the substitution of sinuous springs for coil springs reduced the amount of wire and the cost of the springs by between 60 and 80%, the firmness and comfort offered by only the rows of sinuous wires did not meet the needs of all. Heavier people found that the sinuous wire springs designed for people of average weight do not provide the desired resilience and have a tendency to bottom out. "Bottoming out" as used in this application, is a term of art generally referring to that condition in which the force which has been applied to the springs in a cushion exceeds the ability of the springs to resiliently resist the applied force, thus causing the springs to sag to a position in which further travel of the springs is restrained by supporting structure or by the fully extended springs. The use of stronger, stiffer springs, while providing more comfort to heavier persons, proved to be too hard and uncomfortable for lighter persons. The problem of providing proper support and resilience in cushion seating for heavier persons has also been compounded by the fact that the average person of today is bigger and heavier than the average person of 40 years ago. In addition, today's consumer is more sophisticated and demanding than in the past. Thus, the requirements for seat cushion constructions which can provide acceptable levels of support and comfort to a broader spectrum of people are more demanding today than in the past.

Further, the use of sinuous springs, which are attached to the top edge of the front and rear rails of the frame, placed heavy torsional forces on the rails requiring substantial reinforcing of the frame in order to maintain the frame in proper vertical and parallel alignment.

Attempts to overcome the aforementioned problems and to provide cushion seating with comfort and resilience have included the combination of sinuous springs and coil springs. The coil springs were placed between a flexible base support and the sinuous springs to provide more resilience to the sinuous spring. For example, U.S. Pat. No. 2,234,253 to Hopkes discloses a spring cushion construction which includes a plurality of parallel-disposed sinuous springs with coil springs disposed beneath them. The lower ends of the coil springs are supported by another row of sinuous springs extending transversely to the top row. U.S. Pat. No. 2,280,912 to Hopkes discloses a spring arrangement for bedsprings, boxsprings, etc. A plurality of parallel sinuous springs form the top surface of the cushion spring assembly. The sinuous springs are secured to tapered coil springs which are in turn secured to a lower level of sinuous springs transversely positioned with respect to the top sinuous springs. U.S. Pat. No. 4,597,566 to Scrivner discloses another form of spring cushion seating in which coil springs are placed between a plane of nonresilient wires, supported on the frame by helical edge springs, and a base bar. However, this patent does not provide the feel traditionally associated with the use of sinuous springs.

While the cushion spring structures of the prior art solved some of the problems inherent with sinuous wire-only spring structures by reducing the tendency to bottom out, the prior art structure still lacks the requisite combination of firmness and deep resilience which is desirable in cushion seating today.

Further, none of the prior art discloses a cushion seating structure which has the additional advantage of adjusting the firmness of the cushion to suit individual tastes. While some constructions, such as that disclosed in the previously disclosed '566 patent to Scrivner, provide for factory adjustability, and other constructions, such as that disclosed in U.S. Pat. No. 3,059,249 to *Kamp,* provide for a one-or-two position box spring adjustment, it has heretofore been unknown to provide a spring cushion seating construction in which the firmness of the cushion can be easily adjusted in degrees from "soft" to "firm" without requiring extensive factory manipulation.

SUMMARY OF THE INVENTION

It is an object of the present invention to provide a resilient spring cushion construction for seats, back cushions or the like in which "bottoming out" of the main spring supporting surface is prevented.

It is another object of the present invention to provide a resilient spring cushion construction utilizing rows of parallel sinuous springs in combination with selectively located coil springs which are rigidly supported to provide deep resilient support for the sinuous springs.

It is another object of the invention to provide a seat cushion construction which is readily varied in the manufacturing process to provide a selective degree of effective firmness of the cushion.

It is also an object of the invention to provide a seat cushion construction which provides a ready adjustment of the degree of effective firmness of the cushion.

It is further an object of the present invention to provide a spring structure for upholstered seating which provides a soft initial yieldability and a subsequent greater yield resistance.

The objects of the present invention are met by a spring cushion construction comprising a frame for supporting the construction, which has a front rail, a rear rail and two opposing side rails, and at least one rigid coil spring support member situated between the front and rear rails within the frame. The support member has two ends, each end being attached to the opposing side rails. The construction also comprises a plurality of parallel sinuous wire springs traversing the frame between the front and rear rail in a manner perpendicular to the support member, and a plurality of coil springs in a single row located between the support member and the sinuous springs. Each coil spring is attached to at least one sinuous spring. If more than one support member are present, each support member will have a single row of coil springs disposed thereon. Further, the support member may be adjustable in height to provide greater or lesser resilience in the coil spring.

The combination of the rigid support member, the sinuous spring and the coil spring in the present invention is structurally advantageous over the prior art sinuous spring construction primarily because it greatly reduces torsional stress on the frame between and within the front and the back rail. The design of the present invention advantageously allows the frame stress to be transferred to compression stress on the bottom of the frame. The principal stress is thus transferred to the sides and legs of the frame, which is especially important when sinuous springs approach the bottoming out position such as when heavier persons sit on the cushion. Because of this transfer in the stress areas from the frame itself to the legs of the frame, a lighter, smaller and accordingly less expensive frame may be utilized.

Further, the present invention eliminates weaknesses at the corners and the side edges of the cushions which are inherent with the use of sinuous spring cushions. In prior spring cushion designs utilizing only the sinuous wire springs, the opposite ends of the cushion are not well supported and tend to sag because there is no means to support the cushion beyond the end sinuous wires. In order to alleviate this problem and to attempt to bolster the cushion ends, it has been the prior practice to employ "helper" sinuous wires which are placed in piggy-back fashion on the end pair of sinuous wires. The sinuous wires were also placed closer together throughout the spring construction thus requiring more rows of sinuous wires. For example, a standard sofa in which the springs are constructed according to prior art practice typically may have 16 rows of sinuous wires. Additionally, the 2 end rows, 4 rows in all, were equipped with helper springs. By using the spring construction of the present invention, in which the sinuous wire springs are combined with the coiled springs, the helper wires are eliminated and the number of sinuous wire springs in a standard sofa can be reduced to 13 or less without compromising the firmness and integrity of the spring cushion construction.

The elimination of the sinuous spring wire material is economically advantageous as well due to the reduced amount of wire spring needed. Therefore, any added cost of implementing the single row of coil springs or the means for adjusting the tension of the springs is offset by the reduced cost due to fewer sinuous wire springs and lighter frame construction.

Further still, the use of fewer sinuous wire springs puts less stress on the sides of the frame and results in less weight for the entire structure. Thus, by the use of the spring structure of the present invention, one can expect less breakage of the frame, a lighter unit, more stable seating and reduced "bottoming out" of the cushion structure.

These and other advantages, objects and the like of the present invention will be further described with respect to the following drawings.

DETAILED DESCRIPTION OF THE DRAWINGS

Figure 1:
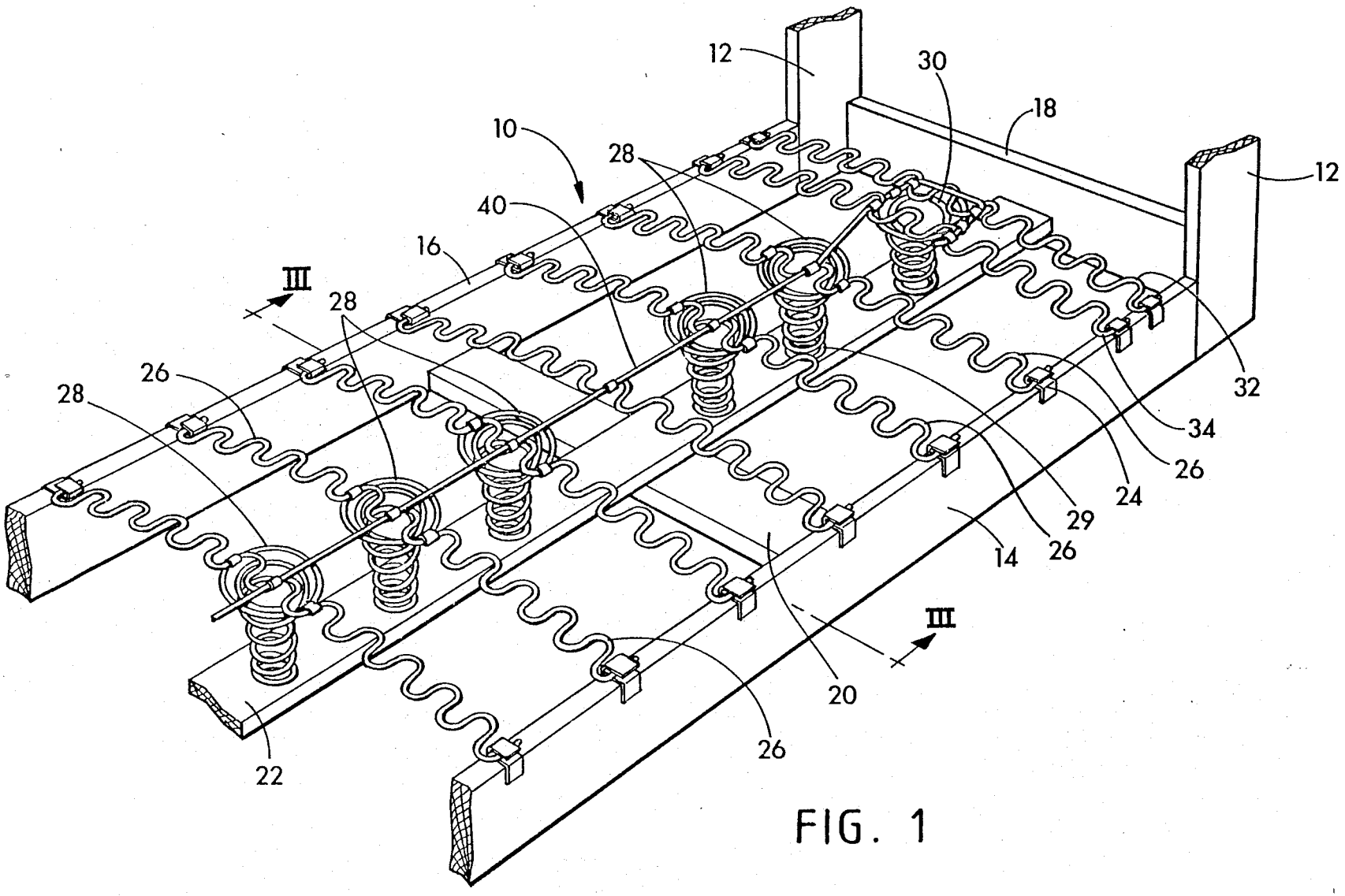
FIG. 1 is a partial top perspective view of the spring structure of the present invention.

The present invention will now be described with reference to the drawings. The same reference numerals will be used for the same or similar features throughout the several drawings.

Referring now to FIG. 1, there is illustrated a preferred embodiment of the spring cushion construction of the present invention for use in a sofa-type construction, normally intended for two or more persons in a seated position. The spring cushion construction includes a base frame 10 preferably made of kiln-dried hardwood, secured to vertical supporting members 12 at the corners in a conventional manner. The stress points may preferably be reinforced with glue blocks for strength of construction. The base frame 10 includes a front rail 14, a rear rail 16 in substantially parallel alignment to the front rail 14 and two substantially parallel side rails 18, only one of which is illustrated. The portion which is not illustrated is substantially similar, albeit a mirror image, to the illustrated end. It is to be understood that furniture legs (not illustrated in the figures) would normally be attached to the base frame 10 at the vertical supporting members 12 and possibly on the front and rear rails.

The frame 10 is of an ordinary type, in which the front rail 14, rear rail 16, and side rails 18 are all rigidly joined together to form an open rectangular frame normally disposed generally horizontally. If necessary, one or more seat brace stretchers or cross slats 20 may be disposed between the front and rear rails 14, 16 in a manner generally parallel to the side rails 18. The cross slats 20 are designed to give extra support to the frame 10. Thus, if the front and rear rails 14, 16 are of a length substantially greater than the length of the side rails 18 making the frame 10 rectangular in shape, such as in the case of a sofa or bench, cross slats 20 are customarily used in order to maintain a parallel alignment between front and rear rails 14, 16.

Situated between the front and rear rails 14, 16 and attached to the side rails 18 by nails, screws, adhesives or other known fastener devices is a support slat 22, having a length generally determined by the distance between the two side rails 18. As illustrated in FIG. 1, the support slat 22 can be designed to rest upon the cross slats 20. Alternatively, the support slat 22 may be divided into sections which abut the cross slat 20 in a fashion similar to the manner in which the support slat 22 is connected to the side rail 18.

Connected to the top surface of the front rails 14 and 16 by U-clips 24 or other securing mechanisms known to the art are a plurality of parallel sinuous or serpentine wire springs 26 having a generally zig-zag pattern and disposed in an upwardly bending arc between front rail 14 and rear rail 16, which is desired for the seat. As illustrated in FIG. 1, the sinuous springs 26 are positioned perpendicularly with respect to the support slat 22.

Figure 3:
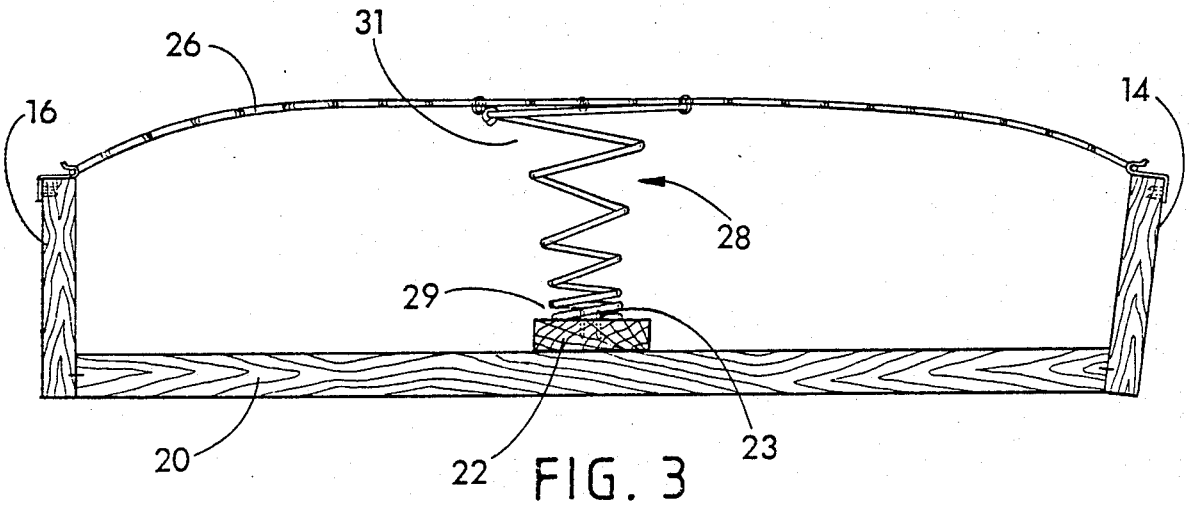
FIG. 3 is a side elevation view of the spring structure taken, along lines III—III of FIG. 1.

Positioned between the sinuous wire springs 26 and the support slat 22 are a plurality of coil springs 28. The bottom end 29 of each of the coil springs 28 is attached to the support slat 22 by means of staples, clips or other attachment means known to the art, illustrated by reference numeral 23 in FIG. 3.

It is within the scope of this invention to provide the cushion construction of the present invention with coil springs of different shapes, such as cylindrical springs, double cone or hourglass shaped springs or tapered coil springs; however the preferred spring for purposes of this invention is a tapered coil spring, as illustrated in the drawings, in which the coils in the upper portion 31 of the spring have a larger diameter than the coils in the lower portion 29. The size of the wire used in the coil springs can be selected within the preferred range of between 8-gauge and 14-gauge in diameter. The construction of the tapered coil spring is such that the spring provides a soft, pillow-like initial resilience due to the larger diameter coils in the upper portion 31 of the tapered spring 28, and a subsequent firmer deep resilience due to the smaller diameter coils in the lower portion 29 of the tapered spring 28. This deep resilience feature characterizes the spring construction with any selected coil shape, the rigidly supported coil springs providing a firm resilience throughout the entire vertical range of movement of the improved spring construction, without bottoming out except under extreme conditions. The preferred coil spring construction is the formation of one row located along the length of the support slat 22 as illustrated in FIG. 1. However, it is within the scope of the present invention to provide the spring cushion construction with more than one row of coil springs 28 on the support slat 22 or to provide more than one support slat 22, each having a single row of coil springs 28 or to provide a combination of these embodiments to the spring cushion construction.

Figure 2:
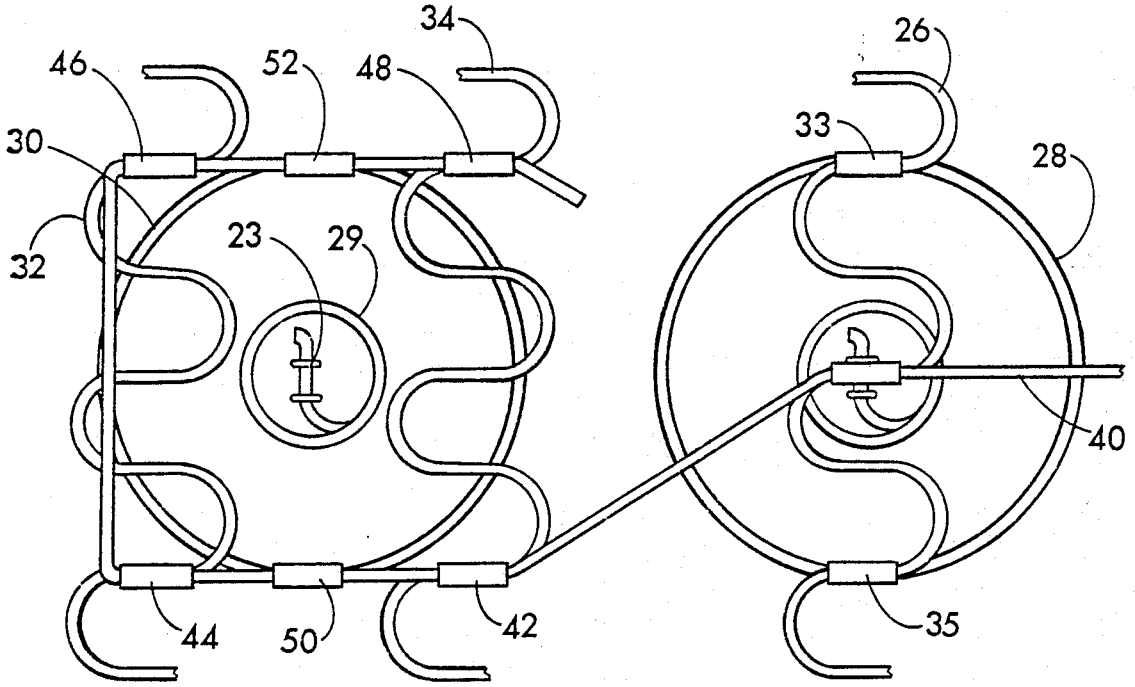
FIG. 2 is a top elevation view of the two end coil springs closest to the side rail of the spring structure of the present invention, connected sinuous wire spring members being partially shown.

As best illustrated in FIGS. 1 and 2, the end coil spring 30 is located nearest the side rail 18, and between and connected to the end sinuous wire spring 32 and the sinuous wire spring 34 adjacent the end sinuous spring 32.

With the exception of the end coil spring 30, all of the coil springs 28 are attached to one sinuous spring 26 by means of conventional insulated clips 31 or other connectors known to the art. As illustrated in FIG. 2, the sinuous spring 26 is connected to the coil spring 28 at two locations 33, 35 by such clips at the outer diameter of the top row of the coil in the coil spring 28.

The coil springs 28 are interconnected by a tie wire 40 placed perpendicularly with respect to the sinuous wire springs 26 to unify spacing between springs. The tie wire 40 preferably extends through the centers of all of the coil springs 28 with the exception of the end coil spring 30. There, the tie wire 40 loops around the end coil spring 30 in a manner illustrated in FIG. 2. The sinuous wire springs 32 and 34 are then connected to the tie wire 40 at connection points 42, 44, 46 and 48. These connection points 42–48 are secured by clips which are similar to clips 31. In order to stablize the end coil spring 30, the end coil spring 30 is attached to the looped tie wire at connection points 50 and 52. The tie wire 40 and the clips 36 may be wrapped in paper or like material in order to reduce noise of spring movement.

As illustrated in FIG. 1, the sinuous wire spring 26 which aligns overhead the cross slat 20 is conspicuous by the absence of any attached coil spring 28. Although this is purely optional, it is preferred because this would normally be the position in which a cushion seam would be located. Therefore, a coil spring would not be necessary as this area would not ordinarily receive a person's weight. If, however, a one piece cushion was placed on the spring construction it would be preferred to have a coil spring under all of the sinuous wire springs.

It is generally preferred to provide each section of the seat construction between the side rails 18 and the sinuous spring 26 or between opposing sinuous wire springs 26 with at least three coil springs 28 in order to provide maximum comfort, resilience and firmness. However, more or less coil springs 28 are within the scope of this invention. It is also within the scope of this invention to provide some form of webbing or padding between the sinuous springs 26 and the coil springs 28 in order to avoid metal contact which would ordinarily result in unwanted "metal squeak" sounds.

The seat construction is completed by placing padding and a cover over the upper surface of the seat construction, defined by the arced surface formed by the sinuous springs 26, in a manner known to the art.

Figure 4:
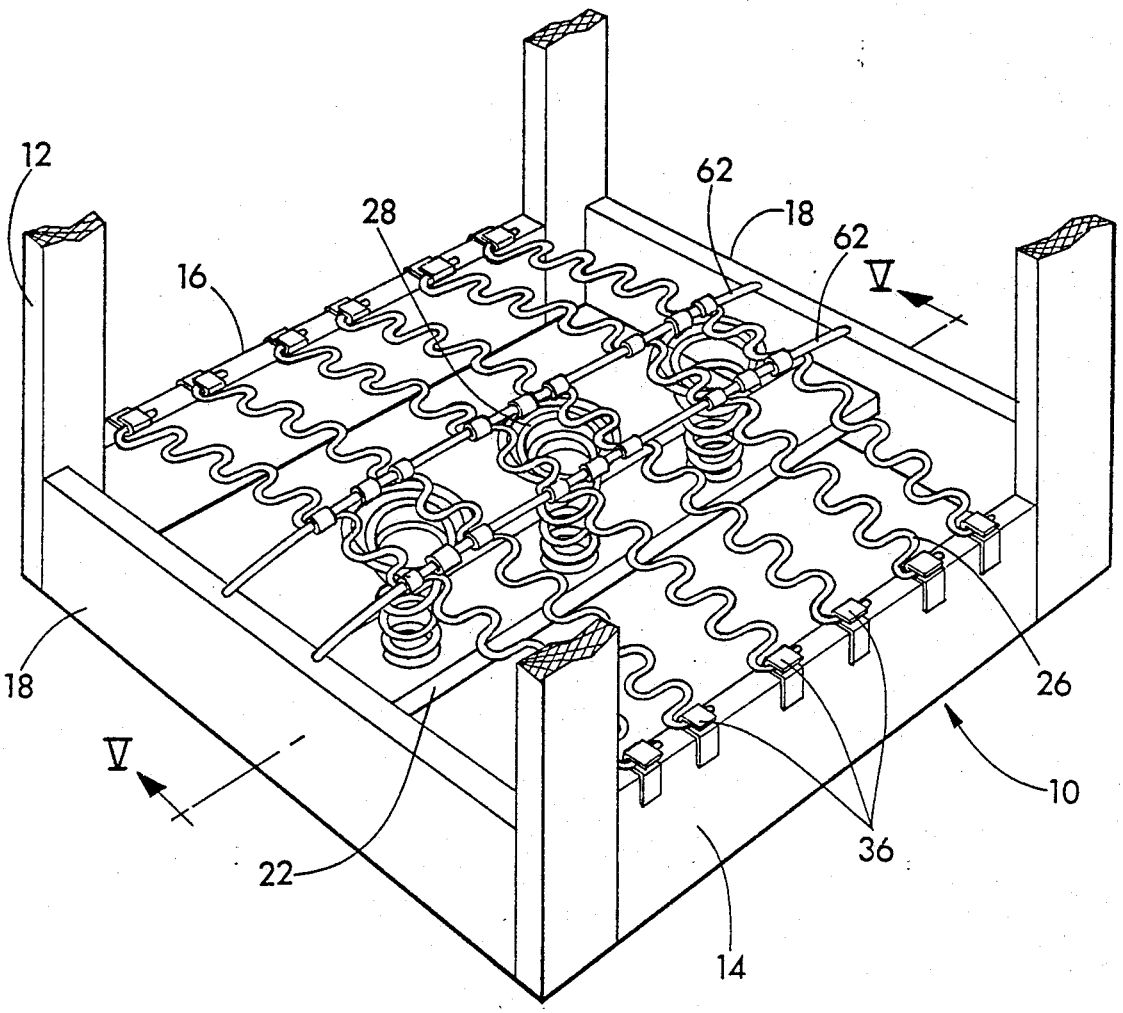
FIG. 4 is a top perspective view of a second embodiment of the spring structure of the present invention.
Figure 5:
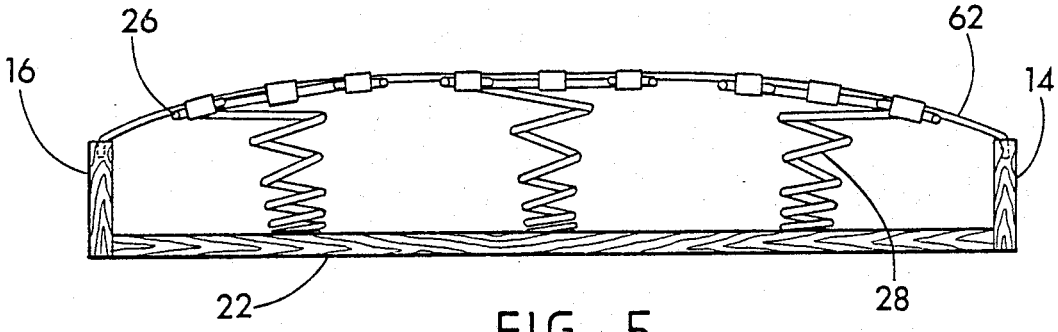
FIG. 5 is a section view taken along lines V—V of the embodiment of FIG. 4.

Referring now to FIGS. 4 and 5, there is illustrated another embodiment of the present invention, in which the base frame 10 is squared in shape and is designed for a chair. Because the front and rear rails 14, 16 are substantially the same length as the side rails 18, a cross slat is optional. The coil springs 28 are attached to support slat 22 in a manner similar to that described with reference to FIG. 1. Further, like the end coil spring 30 in the first embodiment, all of the coil springs 28 in the embodiment illustrated in FIG. 4 preferably have a pair of sinuous wire springs 26 traversing and connected to the coil springs 28. These sinuous springs 26 are connected to the coil springs 28 by clips 31 or other means known to the art.

Unlike the first embodiment, however, the embodiment illustrated in FIGS. 4 and 5 is characterized by two tie wires 62, 62 which are attached to the side rails 18 and which traverse the frame structure 10 in a manner parallel to the support slat 22. The tie wires 62, 62 are maintained in proper position by means of clips attached to the coil springs.

If desired, the firmness of the cushion seat construction of the present invention can be readily adjusted by the manufacturer to suit individual needs and tastes. The various methods of adjusting the firmness of the seat cushion construction include placing the coil spring under tension, changing the gauge of the coil spring, changing the diameter of the coil and changing the composition of the coil material itself. Additionally, a reduction in the number of turns or helicals in the coil will cause the spring to become firmer. The height of the coil spring also affects the firmness of the seat cushion construction. Further, the shape of the coil spring itself can affect the firmness of the seat cushion. It was previously disclosed in this specification that tapered coil springs are preferred for the present invention because the larger diameter coils in the upper portion of the spring provide an initial soft, pillow-like resilience while the smaller diameter coils in the lower portion provide a subsequent firmer resilience. Optionally, the coil springs may take the shape of a cylinder, i.e., all coils having the same diameter, which would impart of softer "feel" than the tapered coil spring. The coil springs may also have a double-cone shape, which would provide yet a softer feel to the seat cushion construction.

Provisions are made for adjusting the firmness of the cushion after manufacture by adjusting the residual coil of the coil spring 28. This is done by an optional adjustment mechanism attached to the support slat 22. The adjustment mechanism of the present invention is unique over the prior art in that the adjustments may be easily made wihtout resort to returning the furniture to the factory. By simply adjusting turn screws, as explained below, the firmness of the seat cushion construction may be altered by the owner according to owner preference. It is also within the scope of the present invention to vary the firmness of different sections of the same seat cushion construction, for example to meet differing "him/her" owner requirements.

Figure 6:
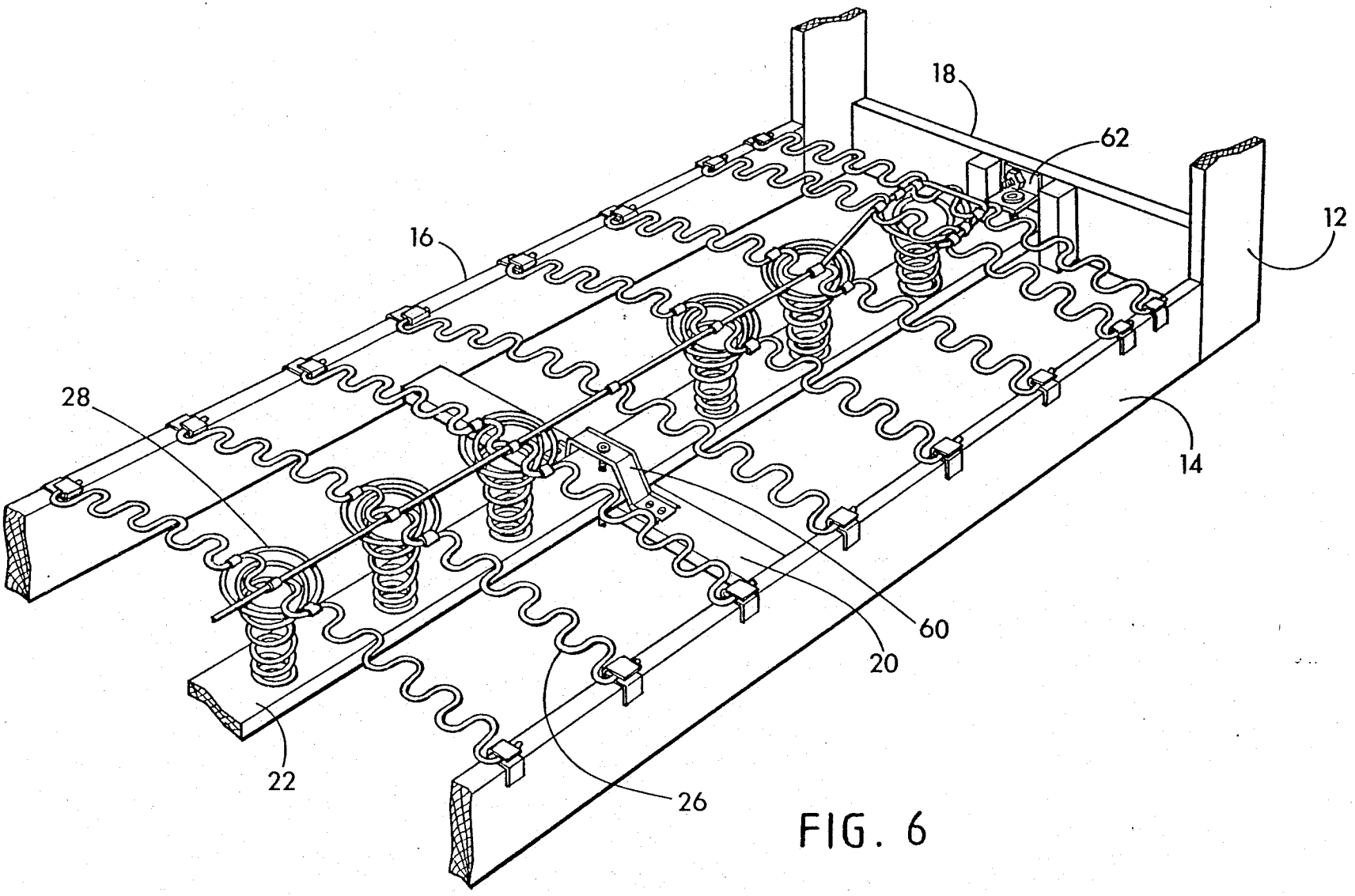
FIG. 6 is a partial top perspective view of the spring structure of another embodiment of the present invention showing an adjustable mechanism for supporting the coil springs.

Reference is now made to FIG. 6 which illustrates the spring cushion construction for a sofa or the like, similar to that illustrated in FIG. 1. In the embodiment in FIG. 1, however, support slat 22 is designed to be raised or lowered in order to increase or decrease the resilience of the coil springs 28 as desired. The reasons for having an adjustment mechanism on a spring cushion construction are basically two-fold. First, the firmness of the spring construction will diminish after a period of use due to the weakening of the bolster padding and the spring construction. Second, it may be desired to adjust the firmness of a new cushion in order to satisfy individual tastes.

The adjustment mechanism includes two components: the center mount adjuster 60 and two end mount adjusters 62, one of which is illustrated in FIG. 6. The center mount adjuster 60 is located at the intersection between the cross slat 20 and the support slat 22. Thus, it is within the scope of this invention to have more than one center mount adjuster 60 if there are more than one cross slat 20/support slat 22 intersections in the spring cushion construction. It is also within the scope of the present invention to have no center mount adjuster 60 as in the case of a chair such as that illustrated in FIG. 5.

Figure 7:
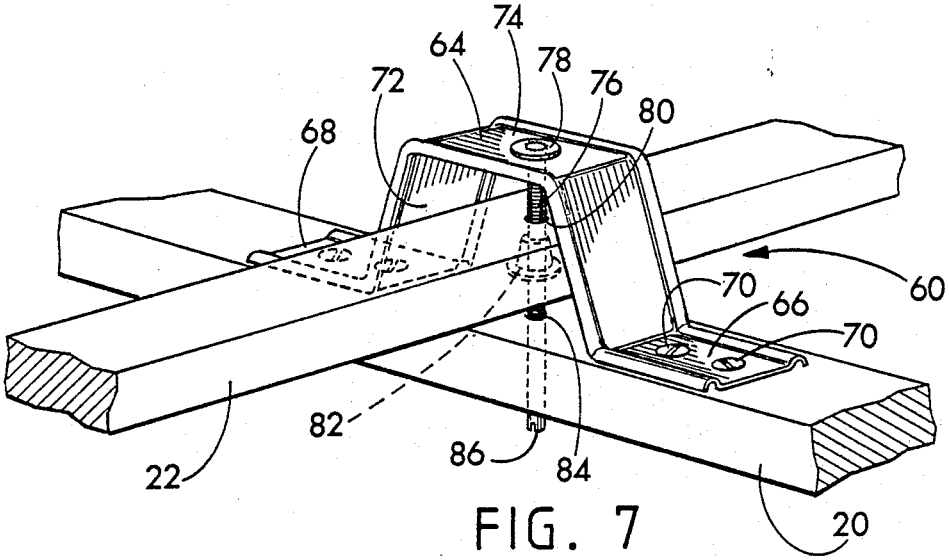
FIG. 7 is a perspective view of one embodiment of the center mount adjuster of the adjustable mechanism illustrated in FIG. 6.

Referring now to FIG. 7, there is illustrated a preferred embodiment of the center mount adjuster 60, which includes a bridge frame 64 having both ends 66, 68 attached to cross slat 20 by screws 70 or other means known to the art, such that an arch or passageway 72 is provided for support slat 22. The upper platform 74 is provided with a hole through which an elongated bolt 76 downwardly passes. The upper end of the bolt 76 is provided with an affixed cap 78 which is welded or otherwise premanently attached to the bolt 76 in order to prevent the bolt 76 from passing completely through the platform 74. The bolt 76 is threadably positioned through a hole 80 within the support slat 22 by means of a threaded nut assembly 82, illustrated by phantom lines, which coacts with the threads on the bolt 76. Therefore, as the bolt 76 is rotated, the support slat 22 is raised or lowered in accordance with the direction of rotation of the bolt 76. The length of the bolt 76 continues past the support slat 22 and through a hole 84 in the cross slat 20, ending at a location 86 just beyond the lower surface of the cross slat 20. The lower end, at 86, of the bolt is preferably notched or otherwise scored to receive a screw driver or other instrument which turns the bolt 76 thus raising or lowering the support slat 22 as desired. Alternatively, the lower end of the bolt 76 may be provided with a hexagonal head or other turning mechanism.

Figure 8:
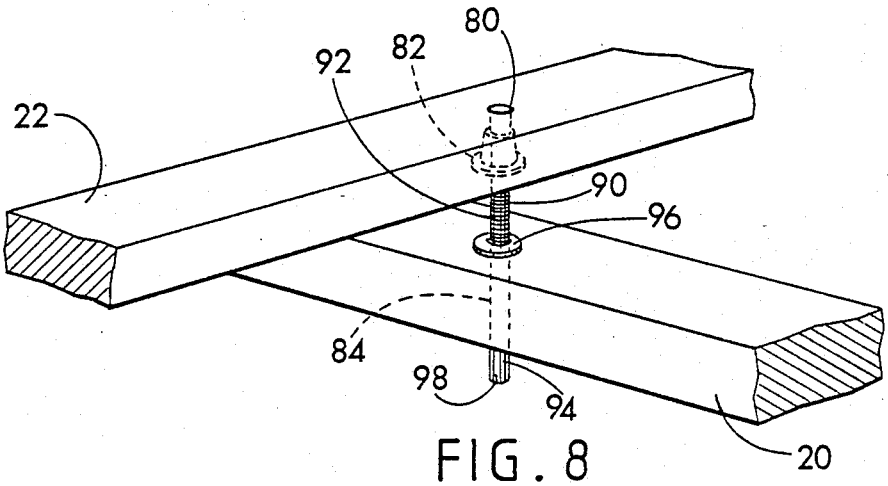
FIG. 8 is a partial perspective view of another embodiment of the center mount adjuster of FIG. 6.

An alternative embodiment to the center mount adjuster 60 is illustrated on FIG. 8. Unlike the embodiment illustrated in FiG. 7, the center amount adjuster 60 in FIG. 8 does not require a frame 64. The center mount adjuster 60 of FIG. 8 includes an elongated bolt 90 having its upper portion 92, i.e., the portion threadably received by the hole 80 in support slat 22, threaded. The lower portion 94, i.e., the portion which is slidably located within the hole 84 of cross slat 20, has a smooth finish. A fixed collar 96 is positioned on the elongated bolt 90 between the threaded portion 92 and the smooth portion 94. In this manner, the elongated bolt 90 is slipped into the hole 84 of the cross slat 20 as illustrated in FIG. 8. The collar 96 prevents the elongated bolt from entering the hole 84 farther than the smooth portion 94 of the elongated bolt 90. The hole 80 of the support slat 22 is defined by a threaded nut-like engagement 82 in the same manner as illustrated in the embodiment of FIG 7. The lower end 98 of the elongated bolt 90 is defined by a slot which allows a screwdriver to turn the bolt 90 or a wing nut or other mechanism for turning the bolt. Thus, as the elongated bolt is rotated, the support slat 22 will raise or lower as desired.

Figure 9:
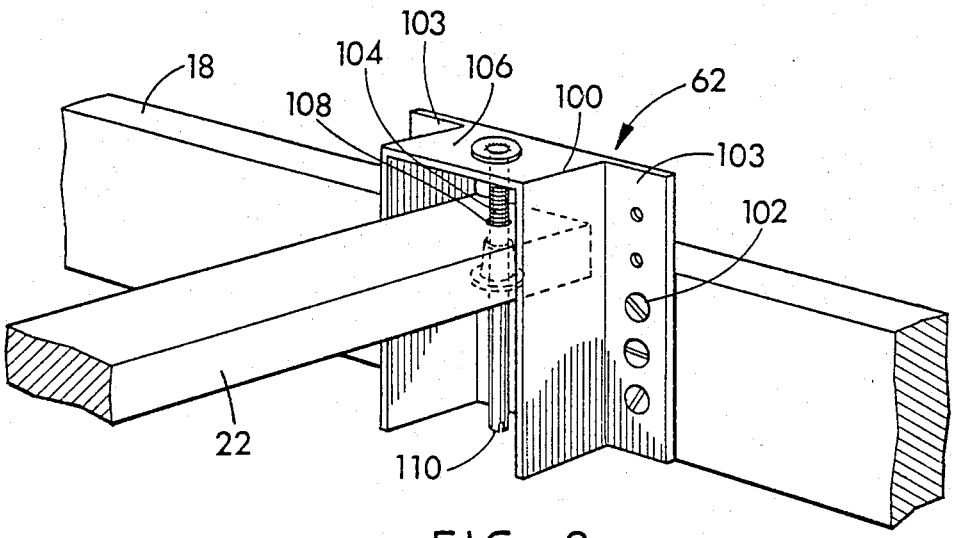
FIG. 9 is a partial perspective view of one embodiment of the end mount adjuster of the adjustable mechanism illustrated in FIG. 6.
Figure 10:
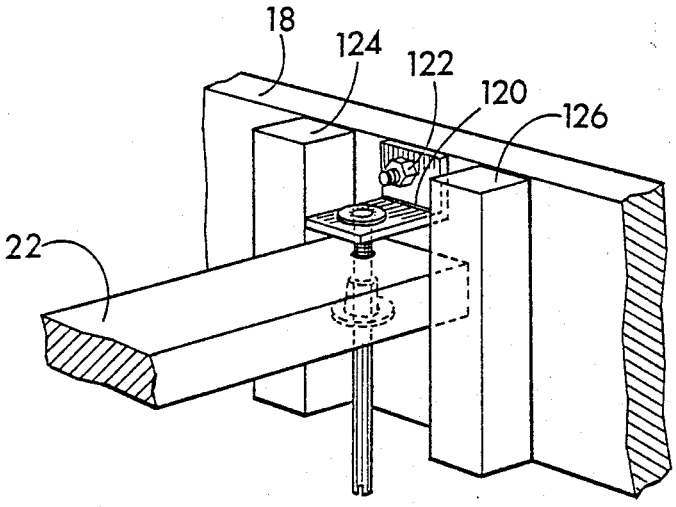
FIG. 10 is a partial perspective view of another embodiment of the end mount adjuster illustrated in FIG. 6.
Figure 11:
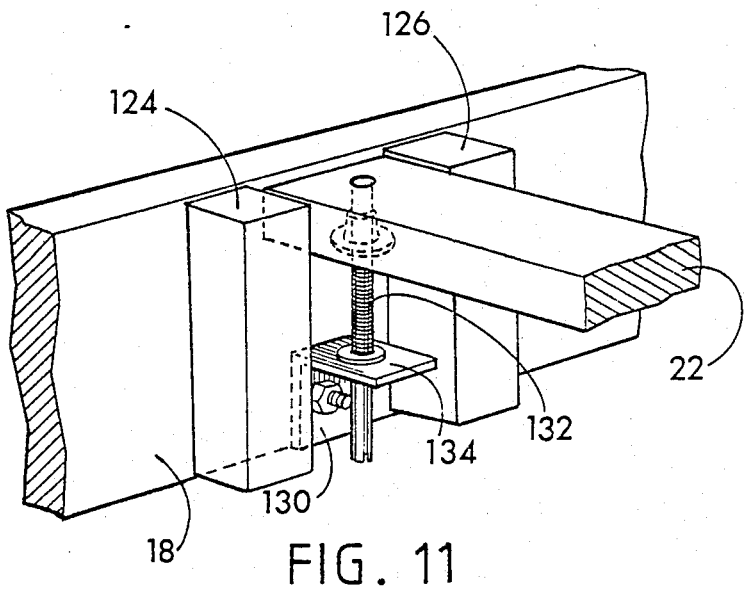
FIG. 11 is a partial perspective view of yet another embodiment of the end mount adjuster as illustrated in FIG. 6.

FIGS. 9–11 illustrate different embodiments of the end mount adjuster 62. Referring now to FIG. 9, there is illustrated an inverted C-shaped frame 100, which allows adjustment of the support slat 22. It is to be noted that if support slat 22 is to be adjusted, it will of course not be fixedly attached to side rail 18. However, the frame 100 is to be fixedly attached to the side rail 18 by screws 102 or other means known to the art securing flanges 103. An elongated bolt 104 is rotatably attached to the top platform 106 of the frame 100. The elongated bolt 104 is similar to the bolt 76 as illustrated and described with respect to FIG. 7. The elongated bolt 104 is threadably attached to the support slat 22 by means of co-acting threads on the hole 108 of support slat 22 in much the same manner as that illustrated and described with respect to FIG. 7. Thus, if the lower end 110 of the elongated bolt 104 is rotated by means of a screwdriver, wing nut or other rotating implement, the support slat 22 will raise or lower as desired.

FIG. 10 illustrates a further embodiment of the end mount adjuster 62. Instead of a rigid frame 100, as illustrated in FIG. 9, an angle iron 120 is suitably substituted and attached to the side rail 18 by any of a number of securing mechanisms such as for example a nut and bolt system illustrated at 122. The support slat 22 is then movably positioned on side rail 18 by means of fixed blocks 124, 126 adjacent support slat 22. Blocks 124, 126 may be made of any materials such as wood, plastic or metal and are fixedly attached to the side rail 18 in order to prevent the support slat 22 from any lateral movement. The elongated bolt and receiving thread mechanism is similar to that illustrated and described with respect to FIG. 9.

FIG. 11 illustrates yet another embodiment of the end mount adjuster 62. In this embodiment, an angle iron 130 is fixedly attached at the lower end of side rail 18. An elongated bolt 132, similar to the bolt illustrated and described with respect to FIG. 8 is rotatably placed within a hole in the upper horizontal platform 134 of the angle iron 130. The threaded portion of the elongated bolt 132 is then threadably received by the threaded portion of the cross slat 22. As the elongated bolt is rotated, the cross slat 22 may then be raised or lowered as desired.

Thus, the spring construction of the present invention has three specific and advantageous features: (1) a plurality of sinuous springs which traverse the front and rear rails; (2) one row of coiled springs; and (3) a rigid coil spring supporting slat. During the initial period of seating, the load is supported principally only by the upper portion of the coil springs which gives the initial soft yieldability known as a pillow effect. However, the rapidly added support of the sinuous springs and the lower part of the coil springs, which support is maintained by the rigid support member, gives the coil spring structure the added dimension of comfort and support. Further, a smooth transition is provided between the lighter or pillow effect and the firm support. Further still, the added dimension of providing a means to adjust the firmness of the seat cushion without requiring factory adjustment gives the present invention a unique added advantage in the field of custom-fit seat cushion constructions.

It is understood that the invention is not confined to the particular construction and arrangement herein illustrated and described, but embraces such modified forms thereof as come within the scope of the following claims.

What is claimed is:

1. A spring cushion construction comprising:

(a) a frame for supporting the construction, the frame comprising a front rail, a rear rail and two opposing side rails;

(b) at least one rigid support member extending between and generally parallel to the front and rear rails within the frame, the support member having two ends, each being attached to the opposing side rails;

(c) a plurality of parallel sinuous wire springs traversing the frame between the front and rear rails in a direction generally perpendicular to the support member;

(d) a plurality of coil springs fixedly mounted at their respective lower ends to said support member and said coil springs spaced along the area of said spring cushion between said front and rear rails and intended to support the load of a seated person's weight, wherein each coil spring is attached at its upper end to at least one sinuous spring, said coil springs being held relatively fixed at their lower ends on said rigid support member during compression of said coil springs under said load for effective absorption of said load on the spring system including said coil and sinuous wire springs to provide deep resilient support to the sinuous springs and (e) a tie wire located substantially parallel to the support member and generally overlying each of said coil springs generally in the central portion thereof, the tie wire being connected to the sinuous and coil springs.

2. The spring cushion construction according to claim 1 further comprising at least one slat having two ends, each end being fixedly attached to the front rail and the rear rail respectively.

3. The spring cushion construction according to claim 2 in which the support member is a unitary piece being partially supported by the at least one slat.

4. The spring cushion construction according to claim 2 in which the support member is sectioned wherein the ends of each section join at the slat.

5. The spring cushion construction according to claim 1 wherein the coil springs define end coil springs located between the support members and the sinuous springs, the end coil springs being connected to two sinuous springs.

6. The spring cushion construction according to claim 1 wherein the coil springs are conical in shape.

7. The spring cushion construction according to claim 1 wherein the coil springs are composed of wire having the dimensions of between 8-gauge and 14-gauge in diameter.

8. The spring cushion construction according to claim 5 further comprising a tie wire located substantially parallel to the support member, the tie wire being connected to the sinuous and coil springs.

9. The spring cushion construction according to claim 8 in which the tie wire extends through the center of the top surface of each coil spring except for the end coil springs in which the tie wire loops round the upper surface of the end coil spring.

10. The spring cushion construction according to claim 1 further comprising means to adjust the resilience of the plurality of coil springs by varying the position of said rigid support member relative to said sinuous wire springs.

11. The spring cushion construction according to claim 10 wherein the means to adjust the resilience of the plurality of coil springs comprises end mount adjusters fixedly attached to the two opposing side rails, wherein the end mount adjusters adjustably position the ends of the support member to each of the opposing rails.

12. The spring cushion construction according to claim 11 further comprising at least one slat having two ends, each end being fixedly attached to the front rail and the rear rail respectively, wherein the support member is a unitary piece being partially supported by at least one slat, the spring cushion further comprising a center amount adjuster positioned at the intersection between the at least one support member and the slat, wherein the center mount adjuster adjusts the height of the at least one support member with respect to the slat.

13. A spring cushion construction comprising:

(a) a frame for supporting the construction, the frame comprising a front rail, a rear rail and two opposing side rails;

(b) at least one rigid support member between and generally parallel to the front and rear rails within the frame, the support member having two ends, each being attached to the opposing side rails;

(c) a plurality of parallel sinuous wire springs traversing the frame between the front and rear rails in a manner generally perpendicular to the support member;

(d) a plurality of coil springs fixedly mounted on each support member and spaced along the area of said spring cushion between said front and rear rails and intended to support the load of a seated person's weight, the coil springs defining end coil springs, located between the support member and the sinuous springs, each coil spring being attached to at least one sinuous spring;

(e) means to adjust the resilience of the plurality of the coil springs by varying the position of said rigid support member relative to the sinuous wire springs; and (f) a tie wire located substantially parallel to the support member and generally overlying each of said coil springs generally in the central portion thereof, the tie wire being connected to the sinuous and coil springs.

14. The spring cushion construction according to claim 13 wherein the means to adjust the resilience of the plurality of coil springs comprises end mount adjusters fixedly attached to the two opposing side rails, wherein the end mount adjusters adjustably position the ends of the support member to each of the opposing rails.

15. The spring cushion construction according to claim 14 further comprising at least one slat having two ends, each end being fixedly attached to the front rail and the rear rail respectively, wherein the support member is partially supported by the slat, the spring cushion further comprising a center mount adjuster positioned at the intersection between the support member and the slat, wherein the center mount adjuster adjusts the height of the support member with respect to the slat.

16. The spring cushion construction according to claim 13 wherein said coil springs are spaced along the area of said spring cushion intended to resist the load of a seated person's weight.

17. The spring cushion construction according to claim 16 wherein the attachment of said coil springs to said sinuous springs is at the upper ends of said coil springs and wherein said coil springs are fixedly mounted at their respective lower ends to said support member with said coil springs being held relatively fixed at their lower ends during compression of said coil springs under said load for effective compression absorption of said seating loads on said springs.

18. A spring cushion construction comprising:

(a) a frame for supporting the construction, the frame comprising a front rail, a rear rail and two opposing side rails, (b) at least one rigid support member extending between and generally parallel to the front and rear rails within the frame, the support member having two ends, each being attached to the opposing side rails;

(c) at least one slat having two ends, each end being fixedly attached to the front rail and the rear rail respectively;

(d) a plurality of parallel sinuous wire springs traversing the frame between the front and rear rails in a direction generally perpendicular to the support member;

(e) a plurality of coil springs fixedly mounted at their respective lower ends to said support member and said coil springs spaced along the area of said spring cushion between said front and rear rails and intended to support the load of a seated person's weight, wherein each coil spring is attached at its upper end to at least one sinuous spring, said coil springs being held relatively fixed at their lower ends on said rigid support member during compression of said coil springs under said load for effective absorption of said load on the spring system including said coil and sinuous wire springs to provide deep resilient support to the sinuous springs; and (f) one of said sinuous springs positioned substantially directly above said slat with no coil spring extending between said slat and said one sinuous spring.

* * * * *